US010384266B2

(12) United States Patent
Behl et al.

(10) Patent No.: US 10,384,266 B2
(45) Date of Patent: Aug. 20, 2019

(54) PROCESS FOR PRODUCING A SHINY LAMINATE STRUCTURE AT LOW TEMPERATURES

(71) Applicant: Heraeus Deutschland GmbH & Co. KG, Hanau (DE)

(72) Inventors: Susanne Behl, Mömbris-Königshofen (DE); Kai-Ulrich Boldt, Hanau (DE)

(73) Assignee: HERAEUS DEUTSCHLAND GMBH & CO. KG, Hanau (DE)

( * ) Notice: Subject to any disclaimer, the term of this patent is extended or adjusted under 35 U.S.C. 154(b) by 266 days.

(21) Appl. No.: 15/023,961

(22) PCT Filed: Sep. 24, 2014

(86) PCT No.: PCT/EP2014/070351

§ 371 (c)(1),
(2) Date: Mar. 22, 2016

(87) PCT Pub. No.: WO2015/044189

PCT Pub. Date: Apr. 2, 2015

(65) Prior Publication Data

US 2016/0236280 A1 Aug. 18, 2016

(30) Foreign Application Priority Data

Sep. 24, 2013 (DE) ..... 10 2013 015 806
Oct. 2, 2013 (DE) ..... 10 2013 016 280

(51) Int. Cl.
*B22F 7/04* (2006.01)
*B22F 9/24* (2006.01)
(Continued)

(52) U.S. Cl.
CPC ..... *B22F 7/04* (2013.01); *B22F 1/0018* (2013.01); *B22F 1/0022* (2013.01);
(Continued)

(58) Field of Classification Search
CPC . C23C 18/08; C23C 18/14; B22F 7/04; B22F 9/24; B22F 1/0018; B22F 1/0022;
(Continued)

(56) References Cited

U.S. PATENT DOCUMENTS 4,877,647 A * 10/1989 Klabunde ..... B22F 9/12 106/1.18
6,951,666 B2 * 10/2005 Kodas ..... C09D 11/30 257/E21.174
(Continued)

FOREIGN PATENT DOCUMENTS

CN 101508527 A 8/2009
DE 19503098 A1 8/1996
(Continued)

OTHER PUBLICATIONS

English translation of the International Search Report dated Feb. 4, 2015 for PCT/EP2014/070351; 3 pages.*
(Continued)

*Primary Examiner* — Helene Klemanski
(74) *Attorney, Agent, or Firm* — Blank Rome LLP

(57) ABSTRACT

Process for producing a layer structure, which comprises the steps:

E1. provision of a composition comprising
- i. gold (Au) particles in an amount in the range from 0.1 to 50% by weight;
- ii. a balance to 100% by weight of a polar, protic organic solvent;
- iii. less than 5% by weight of water, where the % by weight, in each case based on the total mass of the composition, add up to 100% by weight;

E2. application of the composition to a substrate to give a precursor;

(Continued)

E3. heating of the precursor to a temperature in the range from 25 to 200° C. to give the layer structure.

21 Claims, 6 Drawing Sheets

(51) Int. Cl.
*C23C 18/08* (2006.01)
*C23C 18/14* (2006.01)
*B22F 1/00* (2006.01)

(52) U.S. Cl.
CPC ..... *B22F 1/0074* (2013.01); *B22F 9/24* (2013.01); *B22F 2007/042* (2013.01); *B22F 2007/047* (2013.01); *B22F 2009/245* (2013.01); *B22F 2301/255* (2013.01); *B22F 2304/054* (2013.01); *B22F 2998/10* (2013.01)

(58) Field of Classification Search
CPC ..... B22F 1/0074; B22F 2007/042; B22F 2007/047; B22F 2009/245; B22F 2301/255; B22F 2304/054
USPC ..... 106/1.18
See application file for complete search history.

(56) References Cited

U.S. PATENT DOCUMENTS

| | | | | |
|---|---|---|---|---|
| 9,006,296 | B2 * | 4/2015 | Itoh | C09D 5/24 106/1.18 |
| 9,657,396 | B2 * | 5/2017 | Behl | C23C 30/00 |
| 2005/0189520 | A1 * | 9/2005 | Okada | C09D 11/322 252/500 |
| 2005/0204956 | A1 | 9/2005 | Berkei et al. | |
| 2005/0235869 | A1 | 10/2005 | Cruchon-Dupeyrat et al. | |
| 2013/0074728 | A1 | 3/2013 | Ishikawa et al. | |
| 2015/0069638 | A1 * | 3/2015 | Hiratsuka | B22F 1/0074 257/784 |

FOREIGN PATENT DOCUMENTS

| | | | |
|---|---|---|---|
| DE | 202004004017 | U1 | 9/2004 |
| EP | 1571186 | A1 | 9/2005 |
| EP | 1612547 | A1 | 1/2006 |
| EP | 1623781 | A2 | 2/2006 |
| EP | 2177294 | A1 | 4/2010 |
| EP | 2444462 | A1 | 4/2012 |
| JP | 2008127680 | A | 6/2008 |
| JP | 2009106903 | A | 5/2009 |

OTHER PUBLICATIONS

English translation of the Written Opinion of the International Search Authority dated Feb. 4, 2015 for PCT/EP2014/070351; 14 pages.*
English translation of DE 202004004017, Sep. 2004; 16 pages.*
English translation of JP 2008/127680, Jun. 2008; 15 pages.*
English translation of JP 2009/106903, May 2009; 70 pages.*
English translation of the Japanese Office Action for JP 2016/516612, dated Aug. 14, 2018; 5 pages.*
International Search Report issued in PCT/EP2014/070351 dated Jan. 28, 2015.

* cited by examiner

PROCESS FOR PRODUCING A SHINY LAMINATE STRUCTURE AT LOW TEMPERATURES

This application is the national stage of International Patent Application No. PCT/EP2014/070351, filed Sep. 24, 2014, which claims the benefit of German Patent Application No. 102013015806.0, filed Sep. 24, 2013, and German Patent Application No. 102013016280.7, filed Oct. 2, 2013, which are hereby incorporated by reference in their entirety.

The invention relates to a process for producing a layer structure, which comprises the steps: E1. provision of a composition comprising i. gold Au particles in an amount in the range from 0.1 to 50% by weight; ii. a balance to 100% by weight of a polar, protic organic solvent; iii. less than 5% by weight of water, where the % by weight, in each case based on the total mass of the composition, add up to 100% by weight; E2. application of the composition to a substrate to give a precursor; E3. heating of the precursor to a temperature in the range from 25 to 200° C. to give the coated layer structure.

Furthermore, the invention relates to a precursor of a layer structure which is obtainable by means of steps E1. and E2. of the above-described process and also a layer structure obtainable by the above-described process.

In addition, the invention provides a composition comprising: z1. gold (Au) particles in an amount in the range from 0.1 to 50 Au % by weight, based on the total mass of the composition; z2. water in the range from 0 to 5% by weight, based on the total mass of the composition; z3. a polar, protic, organic solvent as balance to 100% by weight, based on the total mass of the composition. The invention further provides an object comprising a layer structure according to the invention or a layer structure obtainable by the process of the invention.

Processes for producing metal layers on ceramic materials are known from the prior art. Thus, in WO00/10941A1, an aqueous solution of a gold thiolate compound is applied to a ceramic in order to achieve colored decoration by means of heating. Heating takes place here at temperatures in the range from 400 to 1200° C.

The prior art does not describe any possible way of applying gold particles to a substrate and forming a bright gold layer therefrom by means of a low temperature.

In general terms, the present invention addresses the problem of at least partly overcoming the disadvantages of the prior art.

A further problem addressed is to convert gold particles on a substrate to a bright layer at low temperature.

In addition, a problem addressed is to provide an efficient and inexpensive process for producing a layer structure comprising a gold layer.

A further problem addressed is to provide a very environmentally friendly process for producing a layer structure.

In addition, a problem addressed is to be able to provide a layer structure with a gold layer whose thickness can be varied within a wide range.

Furthermore, a problem addressed is to provide a process for producing a layer structure having a very firmly adhering gold coating.

A further problem addressed is to be able to produce a layer structure having a very bright surface.

In addition, a problem addressed is to provide a composition which contains gold particles in a solvent, from which a gold layer can be formed at low temperature.

The present invention firstly provides a process for producing a layer structure, which comprises the steps:

E1. provision of a composition comprising
- i. gold (Au) particles in an amount in the range from 0.1 to 50% by weight;
- ii. a balance to 100% by weight of a polar, protic organic solvent;
- iii. less than 5% by weight of water, where the % by weight, in each case based on the total mass of the composition, add up to 100% by weight;

E2. application of the composition to a substrate to give a precursor;

E3. Heating of the precursor to a temperature in the range from 25 to 300° C., preferably in the range from 25 to 250° C. and particularly preferably in the range from 25 to 200° C., to give the layer structure.

The provision of the composition in step E1. can be carried out in any way which a person skilled in the art would choose in order to provide the composition for such a process. The composition is preferably provided in a vessel which is suitable for application of the composition in step E2. Furthermore, the vessel is preferably a vessel which has a valve for metered discharge of the composition.

The composition comprises gold (Au) particles in an amount in the range from 0.1 to 50% by weight, preferably in the range from 0.5 to 40% by weight, or preferably in the range from 1 to 20% by weight, based on the total mass of the composition. Furthermore, the composition comprises less than 5% by weight, preferably less than 4% by weight, or preferably less than 3% by weight, of water, based on the total mass of the composition. The composition can additionally comprise at least one further component.

The composition comprises, as balance to 100% by weight, based on the total mass of the composition, a polar, protic, organic solvent, where the % by weight, in each case based on the total mass of the composition, add up to 100% by weight. The polar, protic, organic solvent can be any polar, protic, organic solvent which a person skilled in the art would use for the process. For the purposes of the invention, protic solvents contain hydrogen atoms which are bound to more electronegative elements and therefore can easily be split off. The polar, protic, organic solvent preferably has from 2 to 20 carbon atoms. Furthermore, the polar, protic, organic solvent has at least one polar, protic radical such as —OH, —SH, —NH, —$NH_2$, —COOH. Typical examples of polar, protic, organic solvents are alcohols, amines (for the purposes of the present invention, amines are aliphatic and cycloaliphatic amines), acid amides and carboxylic acids. Preference is given here to lower alcohols such as, in particular, methanol, ethanol, 1-propanol, 2-propanol, 1-butanol, 2-butanol, 2-methyl-1-propanol and 2-methyl-2-propanol, methoxypropanol, ethoxypropanol, methoxyethanol, ethoxyethanol, 4-hydroxymethyl-1,3-dioxolane, preferably methanol, ethanol, propanol, butanol or a mixture of at least two thereof.

Furthermore, the polar, protic, organic solvent can be selected from the group consisting of a glycol, an amine, an acid amide and a carboxylic acid and mixtures of at least two thereof. The glycol can be selected from the group consisting of 1,2-ethanediol, 1,2-propanediol, 1,2,3-propanetriol (glycerol), 1,2-butanediol, 1,3-butanediol, 1,4-butanediol, 2,3-butanediol, 1,2,3-butanetriol, 1,2-dihydroxybenzene, 1,3-dihydroxybenzene, 1,4-dihydroxybenzene, 1,2,3-trihydroxybenzene, 1,2,4-trihydroxybenzene, 1,4-dihydroxy-2,5-dinitrobenzene, L-adrenaline, a monosaccharide, a disaccharide, a monosaccharide or disaccharide in mixtures with a liquid polyol, 1,1,1-tris(hydroxymethyl)propane, 2,2-dimethylpropane-1,3-diol, a polyethylene glycol, preferably having from 3 to 500 repeating units, e.g. mono-1,2-propylene glycol, di-1,2-propylene glycol, 1,2-butylene glycol, 2,3-butylene glycol, and mixtures of at least two thereof. The amine can be selected from the group consisting of ammonia, methylamine, ethylamine, n-propylamine, i-propylamine, n-butylamine, dimethylamine, diethylamine, di-n-propylamine, di-n-butylamine, pyrrolidine, piperidine, piperazine, N-methyl-piperazine, N-ethylpiperazine, morpholine, ethylenediamine, 1,2-propylenediamine, 1,3-propylenediamine, di(2-cyanoethyl)amine, di(2-aminoethyl) amine, tri(2-aminoethyl)amine, ethanolamine, diethanolamine, triethanolamine, propanolamine, dipropanolamine and tripropanolamine and mixtures of at least two thereof. The acid amide can be selected from the group consisting of formamide, acetamide, propionamide, butanamide, pentanamide, hexanamide, heptanamide, octanamide and mixtures of at least two thereof. The carboxylic acid can be selected from the group consisting of formic acid, acetic acid, acrylic acid, oxalic acid, citric acid, benzoic acid, nicotinic acid, succinic acid, maleic acid, salicylic acid and mixtures of at least two thereof. The alcohols indicated are preferred.

Apart from the polar, protic, organic solvent, the composition preferably comprises at least one further aprotic solvent. The aprotic solvent can be selected from the group consisting of a ketone, an aldehyde and a sulfoxide and mixtures of at least two thereof. The ketone can be selected from the group consisting of ethylene carbonate, N-methylpyrrolidone, M-ethylpyrrolidone, cyclohexanone. The aldehyde can be selected from the group consisting of formaldehyde, acetaldehyde, propionaldehyde, capryl aldehyde and mixtures of at least two thereof. The sulfoxide can be, for example, dimethyl sulfoxide. The composition preferably comprises from 0.1 to 10% by weight, or preferably from 0.2 to 9% by weight, from 0.5 to 5% by weight, based on the total mass of the composition, of the aprotic solvent.

The application of the composition to the substrate to give the precursor can be carried out in any way which a person skilled in the art would choose in order to apply the composition in such a process. Here, the substrate, hereinafter also referred to as substrate layer, is preferably at least partly covered with the composition.

The application can preferably be a deposition of the composition or a dipping into the composition or a combination of the two. The application by deposition of the composition can be effected, for example, by spin coating, impregnation, pouring, dripping-on, squirting, spraying-on, doctor blade coating, painting or printing, for example by means of a metering pump or ink jet, screen, gravure, offset or pad printing onto the substrate layer. The composition is preferably applied to the substrate layer by means of a metering pump, inkjet printing, screenprinting or gravure printing. The composition is preferably applied in a wet film thickness of from 0.01 μm to 250 μm, preferably in a wet film thickness of from 0.1 μm to 50 μm.

For the purposes of the invention, deposition means that the composition used for application, preferably also referred to as liquid or printed composition, is applied by means of an auxiliary in the form of the nozzle to the surface to be covered. This can be effected by means of various auxiliaries. Thus, the printing composition used for application or covering can be sprayed or squirted through a nozzle or deposited by means of a slit die on/onto the substrate layer. Further methods are curtain casting and spin coating. In addition, the printing composition used for application or covering can, for example, be applied or printed by means of a roll or roller to/onto the surface of the substrate. Known spraying or squirting processes are, for example, micrometering or digital printing by means of a nozzle. Here, the printing composition used for application or covering can be expressed or the printing composition used for application is simply applied by dripping onto the surface through the nozzle.

As further printing process, a screenprinting process can preferably be employed. In the screenprinting process, a screen consisting of a very dimensionally stable material such as wood; metal, preferably steel; a ceramic or a polymer and having a selected mesh opening size is arranged on or over the object to be covered, in this case the substrate. The printing composition used for application or covering is applied to this screen via the nozzle and pressed through the mesh by means of a doctor blade. Here, different amounts of printing composition used for application or covering can be applied at different places as a result of a pattern in the screen. Thus, either a uniform film of the printing composition used for covering can be applied or regions having no or little of the printing composition used for application alternate with regions having a large amount of printing composition used for application, depending on the geometry and arrangement of the mesh openings. Preference is given to applying a uniform film of the printing composition used for covering to the surface. The mesh openings of the screen can also be partly closed by appropriately applied materials (copying layers, screenprinting templates) so that the printing composition is transferred to the substrate only in defined regions where the mesh is open in order to obtain, for example, a defined structure such as a pattern. Furthermore, thin films having defined openings (stencils) can also be used instead of screens for covering with the printing composition.

Depending on the configuration of the nozzle or roll or roller and also the viscosity and polarity of the composition used for covering, layers having different thicknesses can be applied to the desired surface of the substrate layer. The layer applied in application or covering is preferably applied in a thickness in the range from 0.5 to 100 μm, preferably in the range from 1 to 50 μm, particularly preferably in the range from 2 to 30 μm. The thickness of the layer applied will hereinafter be referred to as wet layer thickness. The wet layer thickness is dependent on the respective material applied during covering. The wet layer thickness is measured immediately after the step of covering.

In dipping, the surface to be coated is, for example, drawn through a bath comprising the composition used for application. As an alternative, the surface can also simply be dipped into the composition used for application and pulled out again, as is practiced in dip coating. Different thicknesses of the coating can be achieved by multiple dipping during application. In addition, the thickness of the coating is dependent on the choice of the composition used for application, as mentioned above. In this way, wet layer thicknesses of the respective coating in the range from 0.5 to 100 μm, preferably in the range from 1 to 50 μm, particularly preferably in the range from 2 to 30 μm, can be achieved during application. It is also conceivable to employ a combination of the deposition and dipping processes.

In one embodiment, application of the composition used is effected through an application orifice provided above the respective surface of the layer to be covered, for example the substrate. Here, the application orifice is preferably joined to the surface via the composition used for application. This process, also known as micrometering, has the particular property that it makes it possible to apply different thicknesses of the coating to be applied to objects such as the substrate surface here in a simple way. The application orifice can have any conceivable shape and size. The application orifice can, for example, have a shape selected from the group consisting of round, oval, angular and star-shaped and combinations thereof. The application orifice can have an area of from 10 $nm^2$ to 1 $mm^2$, preferably from 100 $nm^2$ to 0.5 $mm^2$, particularly preferably from 100 $nm^2$ to 100 $\mu m^2$. The composition used for application is preferably applied through the nozzle onto the surface by means of a pressure in the range from 2000 to 10000 mbar, preferably in the range from 2500 to 5000 mbar, particularly preferably in the range from 3000 to 4000 mbar. The joining of the composition used for covering to the surface of the substrate makes it possible to avoid detachment of the composition used for application from the surface during application. In this way, it can be ensured that a very homogeneous film can be applied to the surface.

The application of the composition is preferably carried out by means of a screenprinting process or a gravure printing process. In a preferred embodiment of the process, the composition is applied through a screen or by means of a printing cylinder during printing. The screen preferably comprises a frame composed of steel or stainless steel. A mesh or screen, which likewise preferably consists of stainless steel wires or high-strength synthetic fibers, is preferably arranged in the frame.

In a preferred embodiment of the process, the screen has a mesh opening size in the range from 1 to 300 μm, preferably in the range from 2 to 200 μm, or preferably in the range from 3 to 90 μm. This corresponds in each case to a mesh number of from about 70 to 635 mesh, or from about 100 to 600 mesh or from about 200 to 500 mesh, where the unit mesh corresponds to mesh wires/inch or mesh wires/2.54 cm. In the case of application by means of screenprinting, any commercial doctor blade can be used as doctor blade. The doctor blade preferably comprises a polymer. The doctor blade preferably has a doctor blade hardness in the range from 40 to 80 Shore A. The composition preferably has a viscosity in the range from 500 to 100000 mPa*s, or preferably in the range from 700 to 50000 mPa*s.

The substrate can have any shape which allows application of the composition to the substrate. The substrate preferably has at least one contiguous surface. The at least one contiguous surface preferably has an area in the range from 1 $mm^2$ to 10 $m^2$, or preferably in the range from 10 $mm^2$ to 5 $m^2$, or preferably in the range from 100 $mm^2$ to 1 $m^2$. The substrate can have a round, circular, angular, conical or oval configuration. The shape of the substrate is preferably selected from the group consisting of a sphere; a cone; a circle; a polygon such as a triangle, a square, a rectangle, a trapezoid, a pentagon, a hexagon, a heptagon or an octagon; an oval and combinations of at least two thereof. The substrate is preferably covered by the composition to an extent of from 5 to 100%, or preferably to an extent of from 10 to 100%, or preferably to an extent of from 15 to 100%, based on the total contiguous surface area of the substrate, during application in step E2. The composition can be applied over the entire area of the surface of the substrate or in patterns. Thus, regions covered by the composition on the substrate can alternate with regions which are not covered. The pattern can have a regular configuration, for example a checkerboard pattern, a honeycomb pattern or a lozenge pattern. As an alternative or in addition, the composition can be applied in an irregular pattern to the substrate.

The application of the composition in step E2. to give the precursor is followed by heating of the precursor to a temperature in the range from 25 to 200° C., preferably in the range from 40 to 180° C., or preferably in the range from 50 to 150° C., in step E3. The heating of the precursor can be carried out in any way which a person skilled in the art would choose for this purpose. The heating is preferably heating by means of a method selected from the group consisting of irradiation, heating in an oven, heating by means of hot gas and combinations of at least two thereof. Irradiation can, for example, be effected by means of IR radiation, laser radiation, UV radiation or a combination thereof. Heating in an oven, for example a hot air oven, can, for example, be carried out discontinuously or continuously. Heating by means of a hot gas can, for example, be carried out by passing a hot gas stream such as air, nitrogen, oxygen or a mixture thereof over the applied composition. The duration of heating in step E3. is preferably in the range from 0.5 to 10 hours, or preferably in the range from 0.5 to 5 hours, or preferably in the range from 0.5 to 3 hours. The heating gives a layer structure comprising at least the substrate and a gold-containing layer, hereinafter also referred to as gold layer.

In a preferred embodiment of the process, the gold particles have a diameter in the range from 1 to 25 nm, preferably from 2 to 25 nm, preferably in the range from 3 to 20 nm, or preferably in the range from 4 to 18 nm. For the present purposes, the diameter of the gold particles is the average diameter of the particles. The diameter of the gold particles can be determined by means of microscopic examination of the mixture. To determine the size precisely, an imaginary circle is drawn around the two points farthest from one another on the particles. The diameter of the imaginary circle corresponds to the diameter of the particles. The gold particles preferably have a round to oval shape. The gold (Au) particles preferably have a particle size distribution $D_{50}$ of 20 nm, or preferably 15 nm, or preferably 12 nm, which means that not more than 50% of the particles are larger than the indicated diameter. The particle size can be determined using various methods. The particle size is preferably determined by means of laser light scattering, optical microscopy, optical counting of individual particles or a combination of at least two thereof. Furthermore, the determination of the particle size and also of the particle size distribution is preferably carried out with the aid of optical individual evaluation of images recorded by means of transmission electron microscopy (TEM).

In a preferred embodiment of the process, the viscosity of the composition is selected in the range from 1 to 100000 mPas, preferably in the range from 10 to 90000 mPas, or preferably in the range from 20 to 50000 mPas. The viscosity was determined at a shear range of 1/500 s.

In a preferred embodiment of the process, the protic, polar organic solvent comprises at least 20% by weight of a polyalcohol. The polyalcohol is an organic compound which has at least two alcohol radicals. The polyalcohol preferably has from 2 to 10 alcohol radicals. The polyalcohol can have further functional groups. The at least one further functional group can be selected from the group consisting of —S—, —SH, —O—, —OOH, =O, —N—, —NH, $—NH_2$, —P, $—P(OH)_3$, —Cl, —F, —Br and combinations of at least two thereof.

In a preferred embodiment of the process, the polyalcohol has from 2 to 20 carbon atoms.

In a preferred embodiment of the process, the polyalcohol is selected from the group consisting of 1,2-ethanediol, 1,2-propanediol, 1,3-propanediol, 1,2,3-propanetriol (glycerol), 1,2-butanediol, 1,3-butanediol, 1,4-butanediol, 2,3-butanediol, 1,2,3-butanetriol, 1,2-dihydroxybenzene, 1,3-dihydroxybenzene, 1,4-dihydroxybenzene, 1,2,3-trihydroxybenzene, 1,2,4-trihydroxybenzene, 1,4-dihydroxy-2,5-dinitrobenzene, L-adrenaline, a monosaccharide, a disaccharide, a monosaccharide or disaccharide in mixtures with a liquid polyol, 1,1,1-tris(hydroxymethyl)propane, 2,2-dimethylpropane-1,3-diol, a polyethylene glycol, preferably having from 3 to 500 repeating units, and mixtures of at least two thereof.

In a preferred embodiment of the process, the composition further comprises a mercapto-carboxyl compound of the general formula (I), $$SH—R_1—COOH \quad (I)$$

where $R_1$ is a substituted, unsubstituted, branched or unbranched, cyclic or polycyclic $C_1$-$C_{20}$-hydrocarbon radical, or at least one salt of this mercapto-carboxyl compound.

In a preferred embodiment of the process, the substituted, unsubstituted, branched or unbranched, cyclic or polycyclic $C_1$-$C_{20}$-hydrocarbon radical has at least one, preferably two or all, of the following properties:

e1. at least one of the carbon atoms of the $C_1$-$C_{20}$-hydrocarbon radical has been replaced by at least one nitrogen atom, an oxygen atom, a phosphorus atom, a sulfur atom, a hydroxyl group, a carboxyl group, a halide, an amine, an amide, a phosphate group, a sulfate group or a combination of at least two thereof; or e2. the $C_1$-$C_{20}$-hydrocarbon radical can be substituted by further substituted, unsubstituted, branched or unbranched $C_1$-$C_{20}$-hydrocarbon radicals or be branched; or e3. at least one of the carbon atoms of the $C_1$-$C_{20}$-hydrocarbon radical has been replaced by an aromatic radical or in the case of a 5-, 6- or 7-membered heteroaromatic ring by 1, 2, 3 or 4 nitrogen, oxygen and sulfur atoms, wherein the heteroaromatic radical can be substituted by halogen atoms, hydroxyl, nitro, amino groups, protected amino radicals, cyano, trifluoromethyl groups, hydrocarbon radicals having from 1 to 4 carbon atoms, alkoxy radicals having from 1 to 4 carbon atoms.

For the purposes of the present invention, an unsubstituted $C_1$-$C_{20}$-hydrocarbon radical is a hydrocarbon radical consisting of from 1 to 20 —$CH_2$— or —CH— groups. A substituted $C_1$-$C_{20}$-hydrocarbon radical is, for the purposes of the invention, a hydrocarbon radical which consists of from 1 to 20 —$CH_2$— groups and in which an H atom on at least one —$CH_2$— or —CH— group has been replaced by another atom or another group of atoms. The other atom can be selected from the group consisting of a carbon atom, a nitrogen atom, an oxygen atom, a phosphorus atom, a sulfur atom, a halide and combinations of at least two thereof. The other atom group can be selected from the group consisting of a substituted hydrocarbon radical, an unsubstituted hydrocarbon radical, a branched hydrocarbon radical, an unbranched hydrocarbon radical, a saturated hydrocarbon radical, an unsaturated hydrocarbon radical, a cyclic hydrocarbon radical, a polycyclic hydrocarbon radical, an aromatic hydrocarbon radical, a nonaromatic hydrocarbon radical, an acyl group, a hydroxyl group, a carboxyl group, a primary amine, a secondary amine, a tertiary amine, an amide, a phosphate group, a sulfate group, a sulfonate group, a thiol group and combinations of at least two thereof.

For the purposes of the present invention, an unbranched $C_1$-$C_{20}$-hydrocarbon radical is a linear hydrocarbon radical consisting of from 1 to 20 —$CH_2$— or —CH— groups. A branched $C_1$-$C_{20}$-hydrocarbon radical is a hydrocarbon radical which consists of from 1 to 20 —$CH_2$— or —CH— groups and in which an H atom on at least one —$CH_2$— or —CH— group has been replaced by a further hydrocarbon radical. This further hydrocarbon radical can likewise be substituted or unsubstituted and branched or unbranched or else cyclic or polycyclic.

For the purposes of the present invention, a cyclic $C_1$-$C_{20}$-hydrocarbon radical is a hydrocarbon radical which consists of from 1 to 20 —$CH_2$— or —CH— groups and in which the carbon atoms are arranged in a ring. A polycyclic $C_1$-$C_{20}$-hydrocarbon radical is a hydrocarbon radical which consists of from 1 to 20 —$CH_2$— or —CH— groups and in which the carbon atoms are arranged cyclically in two or more rings. The cyclic and polycyclic hydrocarbon radicals can also have aromatic rings.

The substituted, unsubstituted, branched or unbranched, cyclic or polycyclic $C_1$-$C_{20}$-hydrocarbon radical can have the properties mentioned in one of the following combinations:

L1. substituted $C_1$-$C_{20}$-hydrocarbon radical;

L2. unsubstituted $C_1$-$C_{20}$-hydrocarbon radical;

L3. substituted, branched $C_1$-$C_{20}$-hydrocarbon radical;

L4. substituted, unbranched $C_1$-$C_{20}$-hydrocarbon radical;

L5. unsubstituted, branched $C_1$-$C_{20}$-hydrocarbon radical;

L6. unsubstituted, unbranched $C_1$-$C_{20}$-hydrocarbon radical;

L7. substituted, branched, cyclic $C_1$-$C_{20}$-hydrocarbon radical;

L8. substituted, unbranched, cyclic $C_1$-$C_{20}$-hydrocarbon radical;

L9. unsubstituted, branched, cyclic $C_1$-$C_{20}$-hydrocarbon radical;

L10. unsubstituted, unbranched, cyclic $C_1$-$C_{20}$-hydrocarbon radical;

L11. substituted, branched, polycyclic $C_1$-$C_{20}$-hydrocarbon radical;

L12. substituted, unbranched, polycyclic $C_1$-$C_{20}$-hydrocarbon radical;

L13. unsubstituted, branched, polycyclic $C_1$-$C_{20}$-hydrocarbon radical;

L14. unsubstituted, unbranched, polycyclic $C_1$-$C_{20}$-hydrocarbon radical.

As mentioned above, the substituted hydrocarbon radicals can in turn also have the abovementioned properties or property combinations.

In a preferred embodiment of the process, the composition comprises from 0.1 to 4% by weight, preferably from 0.5 to 3.5% by weight, or preferably from 0.3 to 3.0% by weight of the mercapto-carboxyl compound, based on the total mass of the composition.

In a preferred embodiment of the process, the mercapto-carboxyl compound is selected from the group consisting of L-cysteine, D-cysteine, γ-L-glutamyl-L-cysteinylglycine (glutathione), (RS)—N-(2-mercapto-1-oxopropyl)glycine (tiopronin), mercaptosuccinic acid, N-acetylcysteine, thiosalicylic acid, dimercaptosuccinic acid, L-methionine, D-methionine, thiourea, 2-mercaptopropionic acid, thioglycerol, thiodipropionic acid, cystine, methyl 3-mercaptopropionate, Na thioglycolate and mixtures of at least two thereof.

In a preferred embodiment of the process, the composition comprises at least one further metal selected from the group consisting of silver (Ag), platinum (Pt), palladium (Pd), copper (Cu), rhodium (Rh) and combinations of at least two thereof. The at least one further metal can be present as metal particles or as further metal-organic complex. The composition preferably comprises from 0.1 to 5% by weight, or preferably from 0.2 to 4.5% by weight, or preferably from 0.5 to 4% by weight, based on the total mass of the composition, of the further metal.

The organic component of the metal-organic complex preferably comprises a molecule having at least one, at least two or more carbon atoms, preferably from 2 to 100, or preferably from 4 to 50, or preferably from 5 to 20, carbon atoms. The organic component preferably comprises one or two or more nonmetallic atoms other than carbon. Preference is also given to at least one of the at least one nonmetallic atoms interacting at least coordinately, preferably ionically, with the metallic component of the organic compound. It is also possible for a covalent bond to be formed between at least one nonmetallic atom and the metallic component. The nonmetallic atoms are preferably selected from the group consisting of oxygen, sulfur, nitrogen, phosphorus, silicon, a halogen and mixtures of at least two thereof. The at least one carbon atom together with the at least one nonmetallic atom in the organic component of the metal-organic compound preferably forms an organic compound.

In a preferred embodiment of the process, the metal-organic compound has an organic component selected from the group consisting of a carbonate, an oxalate, an ester, a carboxylate, a halocarboxylate, a hydroxycarboxylate, an acetonate, a ketonate, a phosphate, a phosphite, a phosphide, a phosphane, a sulfonate and a sulforesinate and mixtures of at least two thereof. The organic component is preferably selected from the group consisting of acetate, propionate, butanoate, isobutanoate, ethyl butyrate, pentanoate, hexanoate, heptanoate, octanoate, isooctanoate, nonanoate, decanoate, isononate, pivalate, cyclohexanebutyrate, acetylacetonate, ethyl hexanoate, hydroxypropionate, trifluoroacetate, hexafluoro-2,4-pentadionate; neodecanoate, methanesulfonate, ethanesulfonate, propanesulfonate, trifluoromethanesulfonate, p-toluenesulfonate, benzenesulfonate, sulfur-containing unsaturated natural and/or synthetic resins, for example turpentine, rosin and copaiba balsam, and mixtures of at least two thereof.

The composition can, as mentioned above, comprise at least one further component in addition to the abovementioned components. The at least one further component is preferably selected from the group consisting of a binder, a further solvent, a crosslinker, another additive and mixtures of at least two thereof. As binder, it is possible to use, for example, polyurethane, polyacrylates, polyesters, polyvinyl alcohols, polysulfones and mixtures of at least two thereof. The further solvent is preferably selected from the group consisting of dimethyl sulfoxide (DMSO), ethylene glycol, N-methyl-2-pyrrolidone (NMP), ammonia, an alcohol such as ethanol, isopropanol or hexanol, ethoxyethanol, methoxyethanol, methoxypropanol, ethoxyethanol and mixtures of at least two thereof. The crosslinker can, for example, be a silane. The further additive can be selected from the group consisting of nonionic surfactants such as polyalkylene glycol ethers or alkyl polyglucosides, ionic surfactants such as alkylcarboxylate, alkylbenzenesulfonates or alkanesulfonates and mixtures of at least two thereof. The composition preferably comprises from 0.1 to 5% by weight, preferably from 0.5 to 4.5% by weight, or preferably from 1 to 4% by weight, based on the total mass of the composition, of the at least one further component.

In a preferred embodiment of the process, the composition has a pH in the range from 3 to 8, or preferably in the range from 4 to 7.

In a preferred embodiment of the process, the composition further comprises a surface-active substance. The composition preferably comprises from 0.001 to 5% by weight, preferably from 0.005 to 4% by weight, or preferably from 0.01 to 3% by weight, of the surface-active substance. The surface-active substance can be selected from the group consisting of a nonionic surfactant, an anionic surfactant, a cationic surfactant and an amphoteric surfactant and mixtures of at least two thereof. All the surfactants mentioned comprise a nonpolar part and a polar part. The nonpolar part can be selected from the group consisting of an alkyl group, an alkylbenzene group and combinations thereof. The polar part of the nonionic surfactants can be selected from the group consisting of an alcohol group, an ether group, an acrylate group and combinations of at least two thereof. The polar part of the anionic surfactant can be selected from the group consisting of a carboxylate, a sulfonate, a sulfate and mixtures of at least two thereof. The polar part of the cationic surfactant can, for example, be a quaternary ammonium group. The polar part of the amphoteric surfactant can be selected from combinations of at least one polar part of a cationic surfactant and an anionic surfactant. Preference is also given to the surface-active substance comprising a silicon-containing compound. An example of such a compound is dimethylpolysiloxane having a molar mass in the range from 400 to 10000 g/mol, preferably in the range from 500 to 9000 g/mol, or preferably in the range from 600 to 8000 g/mol. Examples of commercially available surface-active products are polyether-modified polydimethylsiloxane, e.g. BYK-333®, polyacrylate, e.g. BYK-381® and also polypropylene glycol, e.g. DISPERBYK-193®, all obtainable from Byk-Chemie GmbH in Wesel.

In a preferred embodiment of the process, a protective layer is applied at least to a part of the layer structure in a further step E4. The protective layer is preferably selected from the group consisting of physically drying surface coatings, oxidatively crosslinking surface coatings, thermally crosslinking surface coatings (e.g. commercial clear coatings for motor cars) and radiation-crosslinking surface coatings.

The substrate to which the composition is applied as described above can be any material which a person skilled in the art would use for producing a layer structure. In a preferred embodiment of the process, the substrate is selected from the group consisting of a paper, a wood, a textile, a glass, a polymer, a metal, a ceramic, a keratinized layer, in particular finger nails or toe nails, and combinations of at least two thereof. The paper can be any type of paper which a person skilled in the art would choose for the substrate in the process. The paper preferably has a weight per unit area in the range from 10 to 500 g/m$^2$, or preferably in the range from 20 to 400 g/m$^2$, or preferably in the range from 50 to 350 g/m$^2$. The wood can be any type and form of wood which a person skilled in the art would choose for the substrate in the process.

The textile can be any textile which a person skilled in the art would choose for the substrate in a layer structure. The textile can be in the form of fibers, woven fabric or nonwoven. The textile can be woven, braided, looped, knitted or unwoven. The textile can comprise, preferably can consist of natural materials, for example wool, cotton, silk, cellulose or other natural fibers. The textile can also comprise, preferably can also consist of fibers of synthetic materials, for example nylon, polyesters, polyacrylic acids, polyacrylonitriles, polyamides, polyaramides or other polymers, or of carbon, glass or metal fibers (wires). The textile can also comprise, preferably can also consist of mixtures of at least two of the materials mentioned.

The glass can be any glass which a person skilled in the art would choose for the substrate in a layer structure. The glass is preferably selected from the group consisting of an alkali glass, a nonalkali glass, a silicate glass and mixtures of at least two thereof. The glass is preferably selected from the group consisting of a soda-lime glass, a lead alkali glass, borosilicate glass, aluminum silicate glass, fused silica and mixtures of at least two thereof.

The polymer can be any polymer which a person skilled in the art would choose for the substrate in a layer structure. The polymer is preferably selected from the group consisting of a polyethylene, polypropylene, a polyethylene terephthalate, a polyvinyl alcohol, a polyvinylpyrrolidone, a polyvinyl chloride, a polyvinyl acetate, a polyvinyl butyrate, a polyacrylic ester, a polyacrylamide, a polymethacrylic ester, a polymethacrylamide, a polyacrylonitrile, a styrene-acrylic ester copolymer, a vinyl acetate/acrylic ester copolymer and an ethylene/vinyl acetate copolymer, a polybutadiene, a polyisoprene, a polystyrene, a polyether, a polyester, a polycarbonate, a polyurethane, a polyamide, a polyimide, a polysulfone, a melamine-formaldehyde resin, an epoxy resin, a silicone resin and mixtures of at least two thereof.

The metal can be any metal which a person skilled in the art would choose for the substrate in a layer structure. The metal is preferably selected from the group consisting of iron, steel, aluminum, silver, titanium, copper, gold, tin, zinc, lead, silicon and mixtures or combinations of at least two thereof.

The ceramic can be any ceramic material which a person skilled in the art would choose for the substrate in a layer structure. The ceramic is preferably selected from the group consisting of an oxide ceramic, a silicate ceramic, a nonoxidic ceramic and mixtures of at least two thereof.

The oxide ceramic is preferably selected from the group consisting of a metal oxide, a semimetal oxide and mixtures thereof. The metal of the metal oxide can be selected from the group consisting of aluminum, beryllium, barium, boron, calcium, magnesium, sodium, potassium, iron, zirconium, titanium and mixtures of at least two thereof. The metal oxide is preferably selected from the group consisting of aluminum oxide ($Al_2O_3$), sodium oxide, boron oxide, calcium oxide, magnesium oxide (MgO), silicon oxide ($SiO_2$), zirconium oxide ($ZrO_2$), yttrium oxide ($Y_2O_3$), aluminum titanate ($Al_2TiO_5$) and mixtures of at least two thereof. The semimetal of the semimetal oxide is preferably selected from the group consisting of boron, silicon, arsenic, tellurium and mixtures of at least two thereof.

The silicate ceramic is preferably selected from the group consisting of a steatite ($Mg_3[Si_4O_{10}(OH)_2]$), cordierite ($(Mg,Fe^{2+})_2(Al_2Si)[Al_2Si_4O_{18}]$), mullite ($Al_2Al_{2+2x}Si_{2-2x}O_{10-x}$ where x=oxygen vacancies per unit cell), feldspar ($(Ba,Ca,Na,K,NH_4)(Al,B,Si)_4O_8$) and mixtures of at least two thereof. The silicate ceramic is preferably a porcelain.

The nonoxidic ceramic can be selected from the group consisting of a carbide, a nitride and mixtures thereof. The carbide can be selected from the group consisting of silicon carbide (SiC), boron carbide ($B_4C$), titanium carbide (TiC), tungsten carbide, cementite ($Fe_3C$). The nitride can be selected from the group consisting of silicon nitride ($Si_3N_4$), aluminum nitride (AlN), silicon aluminum oxynitride (SIALON) and mixtures of at least two thereof.

In a preferred embodiment of the process, the substrate has a conductivity of less than $10^{13}$ S/cm. The substrate preferably has an electrical conductivity in the range from $10^3$ S/cm to $10^{-13}$ S/cm, or preferably in the range from $10^2$ S/cm to $10^{-10}$ S/cm, or in the range from $10^1$ S/cm to $10^{-8}$ S/cm.

In a preferred embodiment of the invention, the application of the composition in step E2. is carried out by means of a brush, a screen, a felt pen, a fountain pen or a nozzle. As brush, it is possible to use any conventional brush which a person skilled in the art would choose for this purpose. The selection and dimensions of the screen and of the nozzle have been indicated above.

The present invention further provides a precursor of a layer structure which is obtainable by means of process steps E1 and E2 of the above-described process.

In a preferred embodiment of the precursor, the precursor has at least one of the following properties:

V1. a thickness of the substrate in the range from 0.1 mm to 5 cm;

V2. a thickness of the composition applied in step E2. in the range from 0.1 μm to 70 μm, preferably in the range from 0.1 to 10 μm, or preferably in the range from 0.1 to 1 μm;

V3. a conductivity of the substrate of less than $10^{13}$ S/cm;

V4. a conductivity of the composition applied in step E2. in the range from $10^{-1}$ S/cm to $10^{-8}$ S/cm.

The present invention further provides a layer structure obtainable by the above-described process.

In a preferred embodiment of the layer structure, the layer structure has at least one of the following properties:

S1. where the layer structure a metal layer comprising at least 70% by weight of gold and having a thickness in the range from 0.05 μm to 1 μm;

S2. a conductivity of less than $10^{13}$ S/cm;

S3. a gloss in the range from 500 to 1300 GU;

S4. a density in the range from 10 to 20 kg/l; preferably in the range from 12 to 19.6 kg/l, or preferably in the range from 15 to 19.4 kg/l.

The present invention further provides a composition comprising:

z1. gold (Au) particles in an amount in the range from 0.1 to 50% by weight;

z2. water in the range from 0 to 5% by weight;

z3. a polar, protic, organic solvent as balance to 100% by weight;

where the % by weight, in each case based on the total mass of the composition, add up to 100% by weight.

In a preferred embodiment of the composition, the composition comprises at least one further component, preferably two further components, or preferably all further components selected from among:

z4. polyvinylpyrrolidone in an amount in the range from 0 to 10% by weight, based on the total mass of the composition;

z5. a polyalcohol in an amount in the range from 0 to 90% by weight, based on the total mass of the composition.

In a preferred embodiment of the composition, the polyalcohol is selected from the group consisting of 1,2-ethanediol, 1,2-propanediol, 1,2,3-propanetriol (glycerol), 1,2-butanediol, 1,3-butanediol, 1,4-butanediol, 2,3-butanediol, 1,2,3-butanetriol, 1,2-dihydroxybenzene, 1,3-dihydroxybenzene, 1,4-dihydroxybenzene, 1,2,3-trihydroxybenzene, 1,2,4-trihydroxybenzene, 1,4-dihydroxy-2,5-dinitrobenzene, L-adrenaline, a monosaccharide, a disaccharide, a monosaccharide or disaccharide in mixtures with a liquid polyol, 1,1,1-tris(hydroxymethyl)propane, 2,2-dimethylpropane-1,3-diol, a polyethylene glycol, preferably having from 3 to 500 repeating units, and mixtures of at least two thereof.

In a preferred embodiment of the composition, the gold (Au) particles have a particle size $D_{50}$ of 20 nm or less, preferably 17 nm or less or preferably 15 nm or less.

The present invention further provides an object comprising a layer structure as described above or a layer structure obtainable by the above-described process. The object can be any object which a person skilled in the art would choose for this purpose. The object can be selected from the group consisting of a glass plate, a cylindrical glass body, an irregularly shaped glass body, a tile, a stone plate, a metal plate, a wooden plate, a polymer plate or film, a vase, a dining plate, a cup, a beaker and combinations of at least two thereof.

The invention will now be illustrated with the aid of measurement methods, nonlimiting examples and illustrative figures.

Measurement Methods

Unless indicated otherwise, the test methods and also the examples are carried out under standard conditions. Unless indicated otherwise, % ranges are % by weight ranges.

Substrates:

The screen-printable pastes were printed onto flat glass plates having the dimensions 10×7×0.3 cm. The flat glass plates were purchased from Leco Glas in Schönsee.

Viscosity:

The viscosity of the printing compositions was measured by means of a cone-and-plate system Physica MCR 301 using the software Rheoplus Version 32 V3.40 (from Anton Paar) at a temperature of 20±0.1° C. using a CP 25-1 measuring cone (angle 1°). After bringing to temperature for 30 seconds, a ramp of the shear rate from 1 $s^{-1}$ to 500 $s^{-1}$ with 25 equidistant steps was generated, with each step being kept constant for a time of in each case 30 seconds. The shear rate of 500 $s^{-1}$ was maintained for 30 seconds. The shear rate was subsequently reduced in 25 equidistant steps as above to 1 $s^{-1}$. The viscosity was determined at a shear rate of 500 $s^{-1}$ at the end of the 30 seconds.

Wet Film Thickness:

To measure the layer thickness of the hardened layers as described above, a Zeiss 5104775 optical sectioning microscope with 200-fold magnification was used. To carry out the measurements, the printed and hardened specimen was placed on the specimen table and the 0 position was set. The horizontal line of the crosshairs was subsequently aligned with the surface of the substrate. The crosshairs were then aligned with the layer surface and the measured value was read off. The measurements were carried out at room temperature (23 to 25° C.).

Transmission Electron Microscopy (TEM):

A Phillips EM420 instrument having an acceleration voltage of 120 KV was used for transmission electron microscopy. One drop of the sample to be examined was dripped onto the TEM grid. The TEM grid was subsequently placed in the instrument. During generation of the high vacuum of $10^{-4}$ Pa required for the measurement, the solvents present in the suspension evaporated completely. The particles discernible in the micrographs were, insofar as they were measurable, all measured individually. The particle sizes reported are based on the statistical evaluation of the individual values obtained.

Conductivity:

To measure the conductivity of the solutions, a Seven Go™ SG3 (from Mettler-Toledo) with an Inlab 738 sensor (Mettler Toledo) was used. Calibration was carried out using aqueous solutions having concentrations of 0.1 and 0.01 mol/l of KCl.

Gloss:

The measurement was carried out in accordance with EN ISO 2813:1999. A model GL0030 instrument from TQC Therminport Quality Control GmbH was used. The measurement was carried out at an angle of incidence/measurement angle of 20°. Glass was used as substrate, and the layer thickness was about 0.3 cm after drying at 150° C. for one hour. Calibration was carried out by means of the polished black glass plate integrated into the instrument.

pH Value:

The pH of the solution was measured directly using a model Portamess pH meter (Knick Elektronische Messgeräte GmbH & Co. KG). The glass electrode, model SE200N with integrated temperature measurement (PT100 resistance sensor; relative to 3 mol/l KCL solution) was dipped into the solution to be measured until a constant pH was indicated.

Screenprinting:

The pastes were applied directly to glass plates by manual printing (plastic doctor blade) through a woven polyester mesh (with or without structure) 120/34 (120 threads/cm having a diameter of 34 μm), commercially available from Sefar AG. Printing was in each case carried out at room temperature and atmospheric pressure.

Drying:

The printed glass plates were introduced into a drying oven (from Thermo Scientific, Typ UT6060) heated to 150° C. and left there for 60 minutes.

EXAMPLES

Example 1

Production of a Nanogold Solution

A) Reduction

A solution of 427 gram of distilled water, 7 g of polyvinylpyrrolidone type K-15 (from AppliChem GmbH, Darmstadt), 22.3 g of anhydrous trisodium citrate (from Merck KGaA, Darmstadt) was heated to 99-100° C. over a period of 25 minutes while stirring in a 3 liter glass beaker. The glass beaker was covered with a clock glass. The temperature was monitored by means of a thermometer. When the temperature was reached, 46.0 g of a 21.75 percent strength sodium gold(III) chloride solution (from Heraeus Precious Metals GmbH), set to pH=6.9, were added over a period of 15 seconds while stirring vigorously. Vigorous foaming occurred and the color changed quickly from yellow via black to purple. To complete the reaction, the solution was subsequently stirred at 97-98° C. for another 10 minutes. The solution was cooled to room temperature.

B) Precipitation

The deep red solution was filtered through a paper filter (from Schleicher & Schuell GmbH, Dassel) having a pore size of from 15 to 20 microns and subsequently brought to a pH of 3.0-3.1/25° C. by means of concentrated hydrochloric acid (from Merck KGaA, Darmstadt). The nanogold was subsequently precipitated as a black precipitate at room temperature by dropwise addition of a 5% strength aqueous solution of the precipitants indicated in Table 1. The precipitation process is complete when the color of the solution becomes black without a bluish cast remaining. When mercaptosuccinic acid was used as precipitant, 300 ml of precipitation solution were required in order to obtain a black precipitate.

C) Purification

The black precipitate was allowed to settle overnight and the supernatent clear, brown-colored mother liquor was carefully decanted off. The precipitate was subsequently washed six times with 100 g each time of acidified distilled water (pH 1.0-1.2) at room temperature. During each washing operation, the mixture was stirred for 10 minutes and allowed to settle for at least 3 hours. After the 3 hours, the washing solution was decanted off. Washing was subsequently carried out with such an amount of distilled water that the pH of the decanted water was 1.8-2.0 at 25° C. The washing water had a dry residue at 100° C. of less than 0.02%. Should the dry residue be greater than 0.02%, further washing operations using washing solution or distilled water are necessary until a dry residue (100° C.) of 0.02% or less is attained.

D) Dispersing

The black residue was slurried in 40 g of deionized water (2.5-3.0 μS/cm conductivity) and brought to a pH of 4.5-5.0/25° C. by means of 10% strength aqueous ammonia solution. This gave a deep red dispersion which was filtered through paper filters (20-30 micron pore size) (from Schleicher & Schuell GmbH, Dassel). The gold content of the resulting suspension was 20% of Au (gravimetric determination of the ignition residue).

TABLE 1

Average particle size D50 in the case of various precipitants

| Sample | Precipitant | Particle size D50 | FIG. | Optical properties |
|---|---|---|---|---|
| a) | Mercaptosuccinic acid | 4.9 nm | FIG. 3 | Bright |
| b) | N-acetylcysteine | 9.1 nm | FIG. 4 | Bright |
| c) | Thiodiethanol | 24.9 nm | FIG. 5 | Silk finish |

The mercaptosuccinic acid was purchased from Alfa Aesar GmbH & Co KG, Karlsruhe, the N-acetylcysteine from Merck KGaA, Darmstadt) and the thiodiethanol from Fluka Chemie GmbH, CH-Buchs. The optical properties were assessed visually.

It can be seen from the results in Table 1 that an increase in the particle size leads to a change in the optical properties of the composition. If the particle size is below 15 nm, a bright composition is obtained. If the particle size is above 20 nm, a silk-finish composition is obtained. The gloss property of the composition can consequently be controlled via the particle size.

Examples of Screen-Printable Pastes

Examples I, II and III

Table 2 lists the constituents for three different screen-printable pastes I, II and III containing gold:

TABLE 2

Illustrative formulations for screen-printable pastes

| | | I | II | III |
|---|---|---|---|---|
| 1 | Glycerol [g] | 15.00 | | |
| 2 | 1,2-propanediol [g] | | 15.00 | 10.00 |
| 3 | 1,2-butanediol [g] | 30.00 | | 5.00 |
| 4 | 2,2-dimethylpropane-1,3-diol [g] | 10.00 | 30.00 | 5.00 |
| 5 | 1,1,1-Tris(hydroxymethyl)propane [g] | 45.00 | 55.00 | 80.00 |
| 6 | Nanogold solution from Example 1 [g] Precipitant a) | 50.00 | 50.00 | 50.00 |
| 7 | Byk 381 [g] | 0.15 | 0.15 | 0.15 |
| | Viscosity [mPas] | 1750 | 3520 | 2640 |
| | Baking result | Reddish gold | Reddish gold | Reddish gold |
| | Gloss [GU] | 380 | 475 | 490 |

The components 1-6 were weighed in order into a glass dish having a capacity of at least 500 g. 40 g of water were in each case evaporated at 85° C. while stirring with a magnetic stirrer. After complete cooling, the component 7 was added and the mixture was homogenized by means of a three-roll mill (from EXAKT, Norderstedt, Laborwalzenstuhl) at room temperature. Two homogenization passes were carried out.

The solution from Example 1 with the precipitant mercaptosuccinic acid sample 1a) or the pastes from Examples I to III were subsequently applied to various substrates, also referred to as application. The conditions, the manner of application and also the conditions during heating are summarized in Table 3. Table 3 also lists the results of this application.

TABLE 3

Examples of the application and heating according to the invention of various substrates with compositions according to the invention in the form of solutions and pastes.

| | Substrate | Application | Drying temperature | Drying time | Result |
|---|---|---|---|---|---|
| 1 | Porcelain | Felt pen, solution from Example 1 | 25° C. | 10 min | Bright, golden |
| 2 | Aluminum | Felt pen, solution from Example 1 | 25° C. | 10 min | Bright, golden |
| 3 | Cromargan | Felt pen, solution from Example 1 | 25° C. | 10 min | Bright, golden |
| 4 | Paper (smooth) | Felt pen, solution from Example 1 | 25° C. | 10 min | Matt-gloss, golden |
| 5 | Melamine resin | Screenprinting, illustrative paste III | 150° C. | 60 min | Matt-gloss, golden |
| 6 | Polycarbonate | Screenprinting, illustrative paste III | 150° C. | 60 min | Matt-gloss, golden |
| 7 | Polyurethane | Screenprinting, illustrative paste III | 150° C. | 60 min | Matt-gloss, golden |
| 8 | Keratinized material | Felt pen, solution from Example 1 | 25° C. | 10 min | Matt-gloss, golden |

Examples IV and V

Table 4 lists the constituents for two different screen-printable pastes IV and V containing gold, platinum and palladium for a white gold treatment:

TABLE 4

Examples of the application and heating according to the invention of various substrates with compositions according to the invention in the form of solutions and pastes

| | Substance | IV | V |
|---|---|---|---|
| 1 | 1,2-propanediol [g] | 10.00 | 10.00 |
| 2 | 1,2-butanediol [g] | 5.00 | 5.00 |
| 3 | 2,2-dimethylpropane-1,3-diol [g] | 5.00 | 5.00 |
| 4 | 1,1,1-tris(hydroxymethyl)propane [g] | 80.00 | 80.00 |
| 5 | Nanogold solution from Example 1 [g] Precipitant sample a) | 50.00 | 50.00 |
| 6 | Nanoplatinum solution [g] | 240 | |
| 7 | Nanopalladium solution [g] | | 240 |
| 8 | Byk 381 [g] | 0.15 | 0.15 |
| | Viscosity [mPas] | 2850 | 2850 |
| | Baking result on glass plates, 150° C. | Grayish silver, bright | Grayish silver, bright |

The components 1-7 shown in Table 4 were weighed in order into an appropriate dish. 279 g of water were in each case evaporated at 85° C. while stirring by means of a magnetic stirrer. After complete cooling, the component 8 is added and the mixture is homogenized by means of a 3-roll mill (from EXAKT, Norderstedt, Laborwalzenstuhl) at room temperature. Two homogenization passes were carried out. Nanoplatinum solution and nanopalladium solution are commercially available from Strem Chemicals Inc. in Kehl.

In the following,

FIG. 1 shows a schematic depiction of the process steps of a process according to the invention;

FIG. 2*a* shows a schematic depiction of a precursor according to the invention;

FIG. 2*b* shows a schematic depiction of a layer structure according to the invention;

FIG. 2*c* shows a schematic depiction of a layer structure according to the invention with additional protective layer;

FIG. 2*d* shows a schematic depiction of an object comprising a layer structure according to the invention;

Figure 1:
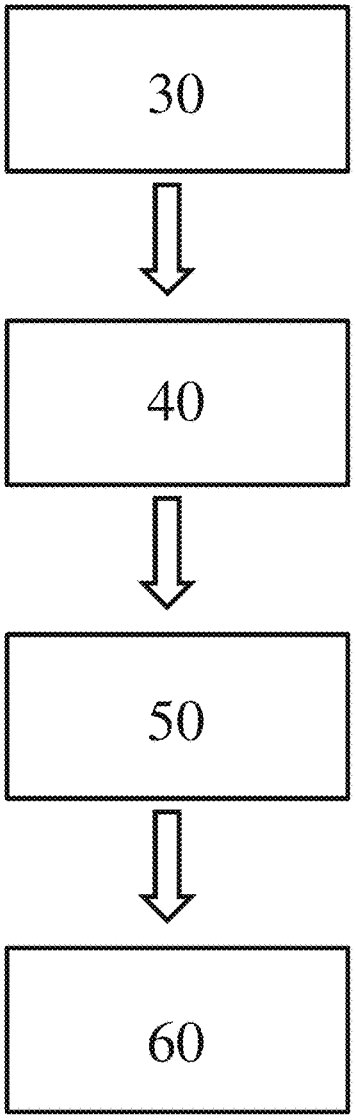

FIG. 1 schematically shows the steps of the process of the invention. In step E1. 30, the composition from Example 1 is provided in a container. In step E2. 40, the composition is applied to a substrate, for example in the form of a glass plate having the dimensions 7*10 cm, by means of screen-printing through a screen having a mesh opening size of 150 μm using a 70 Shore rubber doctor blade. The wet film thickness of the composition is about 20 μm. The substrate together with the composition forms the precursor according to the invention. The substrate together with the composition is heated at 150° C. for 1 hour under atmospheric pressure in a hot air oven from Fisher Scientific, model UT6060, in step E3. 50. Here, a gold layer is formed from the composition and a layer structure according to the invention is obtained in this way. A protective layer in the form of a commercial transparent surface coating (e.g. clear coating for automobile coating, e.g. Profix 2K MS Klarlack CP400 or Profix 2K Klarlack Matt CM10) can optionally also be applied in step E4. 60 at least to the gold layer g formed from the composition 6 or over the entire layer structure.

Figure 2A:
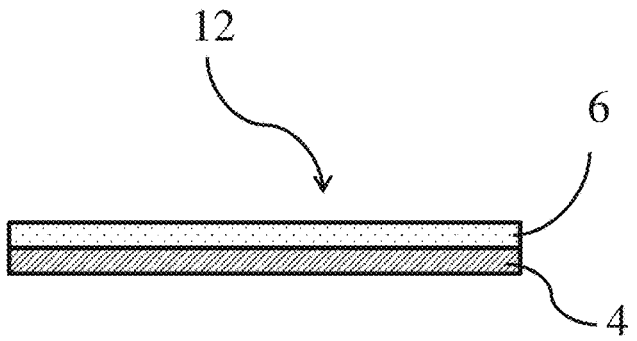

FIG. 2*a* shows a precursor 12 which consists of a substrate 4 to which a composition 6 has been applied. The substrate 4 can be, for example, a paper, a glass or a ceramic. In this example, the substrate 4 is a 1 mm thick polypropylene film having the dimensions 20*20 cm.

Figure 2B:
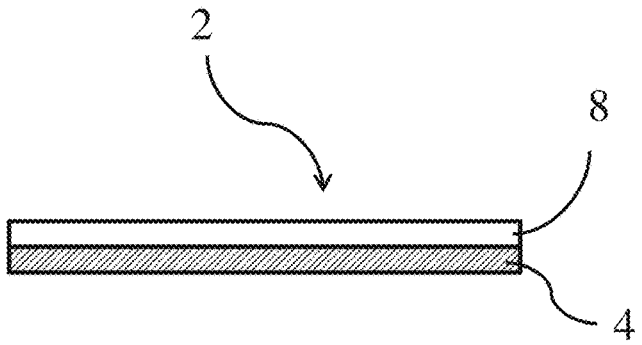

As described for FIG. 1, a layer structure 2 as shown in FIG. 2*b* is formed by heating the precursor 12 shown in FIG. 2*a* at 50° C. This layer structure 2 consists of the substrate 4 and a gold layer 8. The gold layer has a thickness of 1 μm.

Figure 2C:
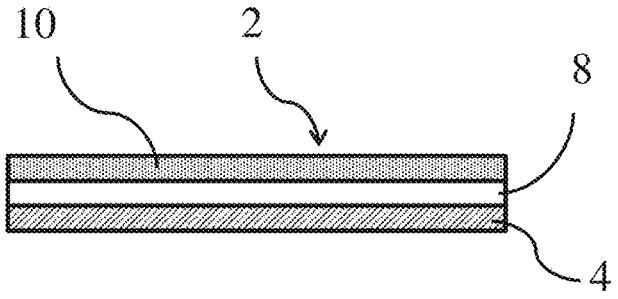

FIG. 2*c* shows the layer structure 2 as per FIG. 2*b*, with a protective layer 10 having additionally been applied on top of the gold layer 8. As an alternative or in addition, the protective layer 10 can also be applied to the underside of the substrate 4.

Figure 2D:
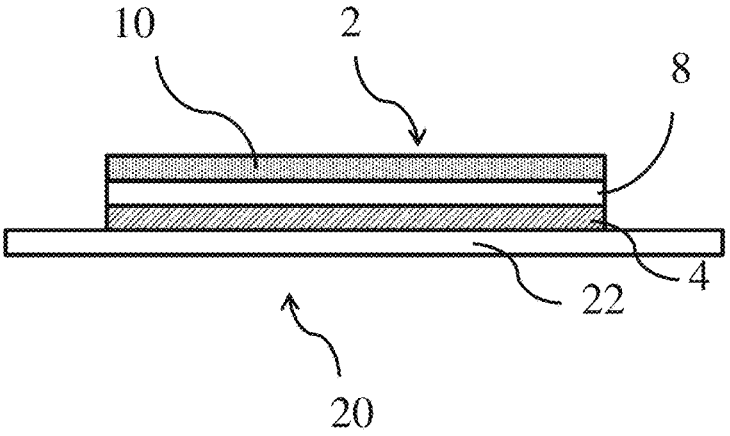

FIG. 2*d* shows an object 20 consisting of a table plate 22 to which a layer structure 2 has been applied. The layer structure 2 comprises the substrate 4, the gold layer 8 and the protective layer 10. The layer structure 2 can have the same dimensions and materials as that described for FIGS. 2*a* and 2*b*.

Figure 3:
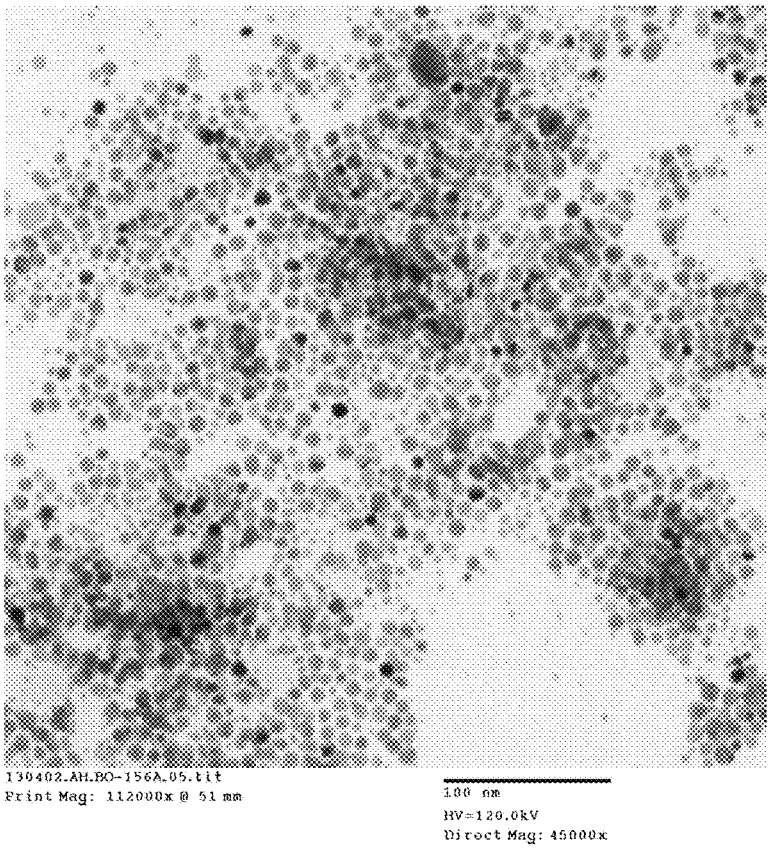
FIG. 3 shows an electron micrograph of a composition according to the invention as per example 1 sample a)

FIG. 3 shows a transmission electron micrograph of a composition 6 according to the invention. The composition corresponds to example 1 sample a). The magnification of the transmission electron micrographs was 45000. It can clearly be seen that the round to oval gold particles have a diameter in the range from 1 to 10 nm, with about half of the particles having a diameter of less than 5 nm, corresponding to a $D_{50}$ of 4.9 nm. 10% of the particles have a diameter of 2.8 nm or less, corresponding to a $D_{10}$ of 2.8 nm, and 90% of the particles have a diameter of 10.1 nm or less, corresponding to a $D_{90}$ of 10.1 nm. Here, particles adhering to other particles were regarded as individual particles. The diameter was determined at a free side of the adhering particles.

Figure 4:
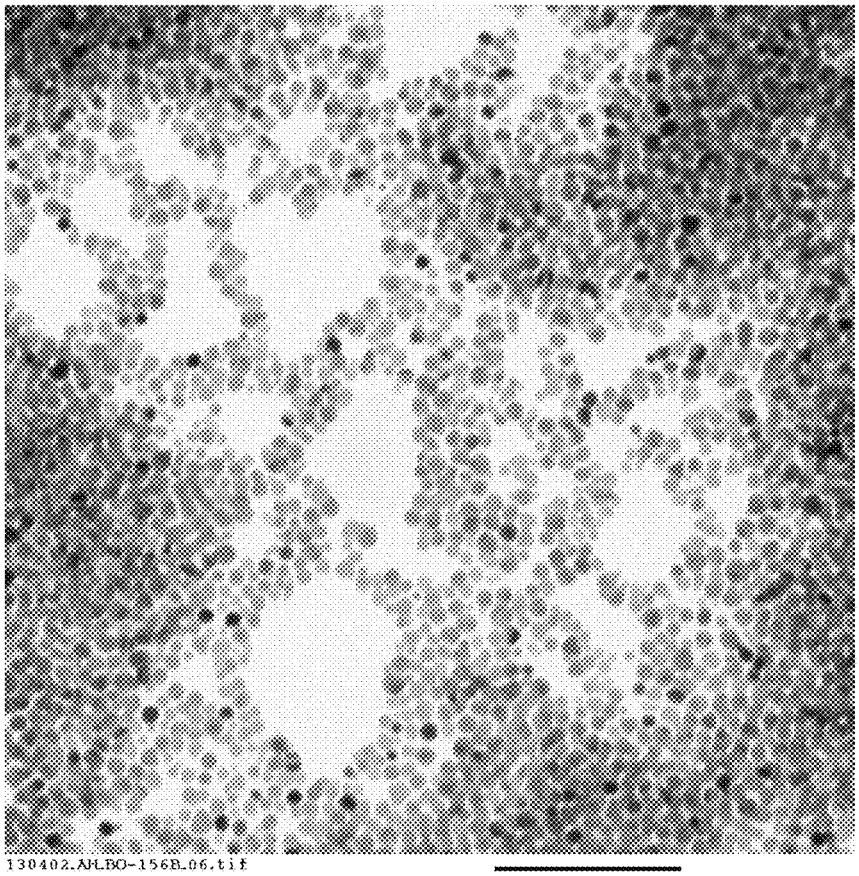
FIG. 4 shows an electron micrograph of a further composition according to the invention as per example 1 sample b)

FIG. 4 shows an image recorded using a transmission electron microscope (TEM) of the same type as described for FIG. 3. FIG. 4 shows a composition 6 as per example 1 sample b. FIG. 4 was taken at an enlargement of 45000. It can be seen in FIG. 4 that the gold particles have diameters in the range from 3 to 16 nm, with about half of the particles having a diameter of less than 10 nm, corresponding to a $D_{50}$ of 9.1 nm. 10% of the particles have a diameter of 5.5 nm or less, corresponding to a $D_{10}$ of 5.5 nm, and 90% of the particles have a diameter of 15.8 nm or less, corresponding to a $D_{90}$ of 15.8 nm. Here, particles adhering to other particles were regarded as individual particles. The diameter was determined at a free side of the adhering particles.

Figure 5:
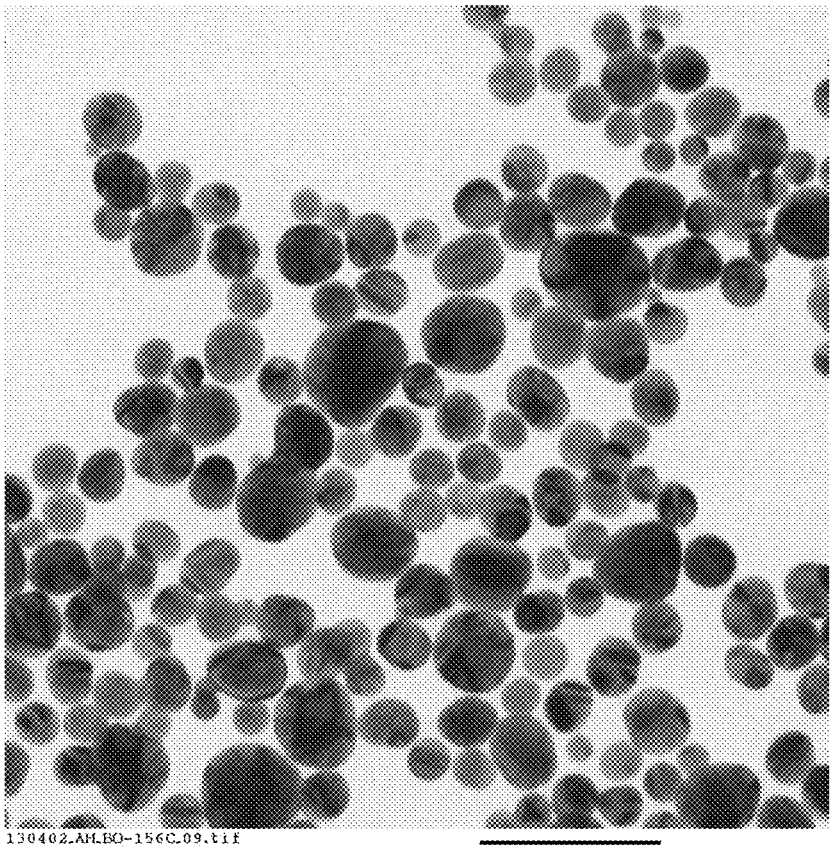
FIG. 5 shows an electron micrograph of a further composition according to the invention as per example 1 sample c).

FIG. 5 shows an image recorded using a transmission electron microscope of the same type as described for FIG. 3. FIG. 5 shows a composition 6 of example 1 sample c) at an enlargement of 45000. It can be seen in FIG. 5 that the gold particles have diameters in the range from 7 to 40 nm. About half of the particles have a diameter of less than 27 nm, corresponding to a $D_{50}$ of 24.9 nm. Here, particles adhering to other particles were regarded as individual particles. The diameter was determined at a free side of the adhering particles.

As can be seen from Table 1, the gloss of the composition 6 depends on the particle size of the Au particles. While the composition 6 in FIGS. 3 and 4 appears bright, the composition 6 in FIG. 5 displays a silk finish.

The transmission electron micrographs were recorded on copper grids provided with carbon films, as are customary for transmission electron micrographs.

LIST OF REFERENCE NUMERALS

2 Layer structure
4 Substrate
6 Composition
8 Gold layer
10 Protective layer
12 Precursor
20 Object
22 Table plate
30 Step E1.
40 Step E2.
50 Step E3.
60 Step E4.

The invention claimed is:

1. A process for producing a layer structure, which comprises the steps:

E1. providing a composition comprising i. gold (Au) particles in an amount in the range from 0.1 to 50% by weight;

ii. a balance to 100% by weight of a polar, protic organic solvent;

iii. less than 5% by weight of water; and iv. a mercapto-carboxyl compound of the general formula (I), or a salt thereof, wherein the general formula (I) is: SH—$R_1$—COOH, where $R_1$ is a substituted, unsubstituted, branched or unbranched, cyclic or polycyclic $C_1$-$C_{20}$-hydrocarbon radical, where the % by weight, in each case based on the total mass of the composition, add up to 100% by weight; and wherein the composition has a pH in the range from 3 to 8;

E2. applying the composition to a substrate to give a precursor; and

E3. heating the precursor to a temperature in the range from 25 to 300° C. to give the layer structure.

2. The process as claimed in claim 1, wherein the gold particles have a diameter in the range from 1 to 25 nm.

3. The process as claimed in claim 1, wherein the viscosity of the composition is selected in the range from 1 to 100000 mPas at a temperature of 20° C.

4. The process as claimed in claim 1, wherein the protic, polar organic solvent comprises at least 20% by weight of a polyalcohol.

5. The process as claimed in claim 4, wherein the polyalcohol has from 2 to 20 carbon atoms.

6. The process as claimed in claim 4, wherein the polyalcohol is selected from the group consisting of 1,2-ethanediol, 1,2-propanediol, 1,3-propanediol, 1,2,3-propanetriol (glycerol), 1,2-butanediol, 1,3-butanediol, 1,4-butanediol, 2,3-butanediol, 1,2,3-butanetriol, 1,2-dihydroxybenzene, 1,3-dihydroxybenzene, 1,4-dihydroxybenzene, 1,2,3-trihydroxybenzene, 1,2,4-trihydroxybenzene, 1,4-dihydroxy-2,5-dinitrobenzene, L-adrenaline, a monosaccharide, a disaccharide, a monosaccharide or disaccharide in mixtures with a liquid polyol, 1,1,1-tris(hydroxymethyl)propane, 2,2-dimethylpropane-1,3-diol, a polyethylene glycol, and mixtures of at least two thereof.

7. The process as claimed in claim 1, wherein the substituted, unsubstituted, branched or unbranched, cyclic or polycyclic $C_1$-$C_{20}$-hydrocarbon radical has at least one, preferably two or all, of the following properties:

e1. at least one of the carbon atoms of the $C_1$-$C_{20}$-hydrocarbon radical has been replaced by at least one nitrogen atom, an oxygen atom, a phosphorus atom, a sulfur atom, a hydroxyl group, a carboxyl group, a halide, an amine, an amide, a phosphate group, a sulfate group or a combination of at least two thereof; or e2. the $C_1$-$C_{20}$-hydrocarbon radical can be substituted by a substituted, unsubstituted, branched or unbranched, cyclic or polycyclic $C_1$-$C_{20}$-hydrocarbon radicals or the $C_1$-$C_{20}$-hydrocarbon radical can be branched; or e3. at least one of the carbon atoms of the $C_1$-$C_{20}$-hydrocarbon radical has been replaced by an aromatic radical or in the case of a 5-, 6- or 7-membered heteroaromatic ring by 1, 2, 3 or 4 nitrogen, oxygen and sulfur atoms, wherein the heteroaromatic radical can be substituted by halogen atoms, hydroxyl, nitro, amino groups, protected amino radicals, cyano, trifluoromethyl groups, hydrocarbon radicals having from 1 to 4 carbon atoms, alkoxy radicals having from 1 to 4 carbon atoms.

8. The process as claimed in claim 1, wherein the composition comprises from 0.1 to 4% by weight of the mercapto-carboxyl compound, based on the total mass of the composition.

9. The process as claimed in claim 1, wherein the mercapto-carboxyl compound is selected from the group consisting of L-cysteine, D-cysteine, γ-L-glutamyl-L-cysteinylglycine (glutathione), (RS)—N-(2-mercapto-1-oxopropyl) glycine (tiopronin), mercaptosuccinic acid, N-acetylcysteine, thiosalicylic acid, dimercaptosuccinic acid, L-methionine, D-methionine, thiourea, 2-mercaptopropionic acid, thioglycerol, thiodipropionic acid, cystine, methyl 3-mercaptopropionate, Na thioglycolate and mixtures of at least two thereof.

10. The process as claimed in claim 1, wherein the composition comprises at least one further metal selected from the group consisting of silver (Ag), platinum (Pt), palladium (Pt), copper (Cu), rhodium (Rh) and combinations of at least two thereof.

11. The process as claimed in claim 1, wherein the composition further comprises a surface-active substance.

12. The process as claimed in claim 1, wherein a protective layer is applied at least to a part of the layer structure in a further step E4.

13. The process as claimed in claim 1, wherein the substrate is selected from the group consisting of a paper, a wood, a textile, a glass, a polymer, a metal, a ceramic, a keratinized layer and combinations of at least two thereof.

14. The process as claimed in claim 1, wherein the substrate has a conductivity of less than $10^{13}$ S/cm.

15. The process as claimed in claim 1, wherein the application of the composition in step E2 is carried out by means of a brush, a screen, a felt pen, a fountain pen or a nozzle.

16. A precursor of a layer structure obtained by means of process steps E1 and E2 of the process as claimed in claim 1.

17. The precursor as claimed in claim 16, wherein the precursor has at least one of the following properties:

V1. a thickness of the substrate in the range from 0.1 mm to 5 cm;

V2. a thickness of the composition applied in step E2 in the range from 0.1 μm to 70 μm;

V3. a conductivity of the substrate of less than $10^{13}$ S/cm; or

V4. a conductivity of the composition applied in step E2 in the range from $10^{-1}$ S/cm to $10^{-8}$ S/cm.

18. A composition comprising:

z1. gold (Au) particles in an amount in the range from 0.1 to 50% by weight;

z2. water in the range from 0 to 5% by weight;

z3. a polar, protic, organic solvent as balance to 100% by weight; and z4. a mercapto-carboxyl compound of the general formula (I), or a salt thereof, wherein the general formula (I) is: SH—$R_1$—COOH, where $R_1$ is a substituted, unsubstituted, branched or unbranched, cyclic or polycyclic $C_1$-$C_{20}$-hydrocarbon radical, where the % by weight, in each case based on the total mass of the composition, add up to 100% by weight; and wherein the composition has a pH in the range from 3 to 8.

19. The composition as claimed in claim 18, wherein the composition comprises at least one further component selected from:

z4. polyvinylpyrrolidone in an amount in the range from 0 to 10% by weight, based on the total mass of the composition; or z5. a polyalcohol in an amount in the range from 0 to 90% by weight, based on the total mass of the composition.

20. The composition as claimed in claim 19, wherein the polyalcohol is selected from the group consisting of 1,2-ethanediol, 1,2-propanediol, 1,2,3-propanetriol (glycerol), 1,2-butanediol, 1,3-butanediol, 1,4-butanediol, 2,3-butanediol, 1,2,3-butanetriol, 1,2-dihydroxybenzene, 1,3-dihydroxybenzene, 1,4-dihydroxybenzene, 1,2,3-trihydroxybenzene, 1,2,4-trihydroxybenzene, 1,4-dihydroxy-2,5-dinitrobenzene, L-adrenaline, a monosaccharide, a disaccharide, a monosaccharide or disaccharide in mixtures with a liquid polyol, 1,1,1-tris(hydroxymethyl)propane, 2,2-dimethylpropane-1,3-diol, a polyethylene glycol, and mixtures of at least two thereof.

21. The composition as claimed in claim 18, wherein the gold particles have a particle size $D_{50}$ of 20 nm or less.

* * * * *